US011744378B2

(12) United States Patent
Van Doornewaard

(10) Patent No.: US 11,744,378 B2
(45) Date of Patent: Sep. 5, 2023

(54) SUPPORT CONSTRUCTION FOR CONDITIONED FURNITURE, AND ASSOCIATED SYSTEMS AND METHODS

(71) Applicant: Pure-Development 1 B.V., Baarn (NL)

(72) Inventor: Barry Van Doornewaard, Baarn (NL)

(73) Assignee: Pure-Development 1 B.V.

( * ) Notice: Subject to any disclaimer, the term of this patent is extended or adjusted under 35 U.S.C. 154(b) by 0 days.

(21) Appl. No.: 17/198,078

(22) Filed: Mar. 10, 2021

(65) Prior Publication Data

US 2022/0287467 A1 Sep. 15, 2022

(51) Int. Cl.
*A47C 19/02* (2006.01)
*A47C 21/04* (2006.01)

(52) U.S. Cl.
CPC ..... *A47C 19/024* (2013.01); *A47C 21/044* (2013.01)

(58) Field of Classification Search
CPC ..... A47C 21/044; A47C 21/04; A47C 21/048; A47C 19/024; A47C 19/021; A47C 19/02; A61G 7/05784
See application file for complete search history.

(56) References Cited

U.S. PATENT DOCUMENTS 3,164,110 A * 1/1965 Bofinger ..... A47C 19/202 D7/552.2
3,266,064 A 8/1966 Murray
3,513,490 A * 5/1970 Wagner ..... A47C 19/024 5/8
3,736,604 A 6/1973 Carson
3,746,835 A 7/1973 Yu et al.
4,186,452 A * 2/1980 Underwood ..... A47C 17/86 5/493
4,939,804 A 7/1990 Grant
5,408,711 A 4/1995 McClelland
5,678,352 A 10/1997 Leitner et al.
5,887,304 A 3/1999 Von Der Heyde
6,584,627 B1 7/2003 Yang
7,178,183 B2 * 2/2007 Cho ..... A47C 27/12 5/948
7,837,932 B2 11/2010 Hedman
(Continued)

FOREIGN PATENT DOCUMENTS

CA 2482406 C 9/2003
CN 2191584 Y 3/1995
(Continued)

OTHER PUBLICATIONS

Partial search report issued for corresponding NL Application No. 2027734, Applicant: Pure-Development 1 B.V., dated Dec. 9, 2021, 16 pages.

(Continued)

*Primary Examiner* — David R Hare
*Assistant Examiner* — Alison N Labarge
(74) *Attorney, Agent, or Firm* — Perkins Coie LLP

(57) ABSTRACT

Disclosed is a bed construction for conditioned furniture e.g., a ventilated bed, comprising a base frame; a leg module extending from the base frame; and a tub-shaped outer shell, supported by the base frame, forming a cavity for accommodating a ventilation unit. The base frame can be arranged in the cavity, wherein the leg module extends from the base frame through respective openings in a bottom of the outer shell.

24 Claims, 6 Drawing Sheets

(56) References Cited

U.S. PATENT DOCUMENTS

| | | | | |
|---|---|---|---|---|
| 8,272,143 | B1 | 9/2012 | Hedman | |
| 9,131,675 | B2 | 9/2015 | Smith | |
| 9,756,952 | B2 | 9/2017 | Alletto, Jr. et al. | |
| D819,357 | S | 6/2018 | van Doornewaard | |
| 10,034,550 | B2 | 7/2018 | Rydsund | |
| 2003/0019044 | A1 | 1/2003 | Larsson et al. | |
| 2003/0070235 | A1 | 4/2003 | Suzuki et al. | |
| 2003/0145380 | A1 | 8/2003 | Schmid | |
| 2004/0253920 | A1 | 12/2004 | Schoettle | |
| 2005/0229319 | A1 | 10/2005 | Cho | |
| 2006/0053558 | A1 | 3/2006 | Ye | |
| 2006/0101577 | A1 | 5/2006 | Lussier | |
| 2007/0136952 | A1 | 6/2007 | Sargent | |
| 2008/0313810 | A1* | 12/2008 | Cretsinger | A47C 23/002 5/503.1 |
| 2009/0064411 | A1 | 3/2009 | Marquette et al. | |
| 2010/0005588 | A1 | 1/2010 | Christopher | |
| 2010/0011502 | A1 | 1/2010 | Brykalski et al. | |
| 2010/0115696 | A1* | 5/2010 | Felix, Jr. | A47C 19/024 5/201 |
| 2010/0319125 | A1 | 12/2010 | Ko | |
| 2011/0296610 | A1* | 12/2011 | Moon | A47C 19/025 5/308 |
| 2012/0186138 | A1 | 7/2012 | Bell et al. | |
| 2012/0233907 | A1 | 9/2012 | Pattison et al. | |
| 2012/0240451 | A1 | 9/2012 | Ricks | |
| 2012/0285944 | A1 | 11/2012 | Bermudez | |
| 2013/0061395 | A1* | 3/2013 | Karl | A47C 19/021 5/503.1 |
| 2013/0263496 | A1 | 10/2013 | Maloney et al. | |
| 2013/0276358 | A1 | 10/2013 | Knote et al. | |
| 2014/0109314 | A1 | 4/2014 | Boersma et al. | |
| 2014/0137569 | A1 | 5/2014 | Parish et al. | |
| 2014/0173970 | A1 | 6/2014 | Martin | |
| 2014/0201909 | A1 | 7/2014 | Weyl | |
| 2014/0271349 | A1 | 9/2014 | Gowda et al. | |
| 2015/0208814 | A1 | 7/2015 | Alletto, Jr. et al. | |
| 2016/0136385 | A1 | 5/2016 | Scorcioni | |
| 2017/0202365 | A1* | 7/2017 | Polevoy | A47C 19/024 |
| 2017/0296412 | A1 | 10/2017 | Hung | |
| 2017/0348182 | A1 | 12/2017 | Yoo et al. | |
| 2018/0110341 | A1 | 4/2018 | Reynolds | |
| 2018/0160819 | A1 | 6/2018 | Rutledge | |
| 2018/0271300 | A1 | 9/2018 | Wang | |
| 2019/0105458 | A1 | 4/2019 | Hammes et al. | |
| 2019/0126000 | A1 | 5/2019 | Main et al. | |
| 2019/0320808 | A1 | 10/2019 | Chapin et al. | |
| 2019/0380501 | A1 | 12/2019 | Reynolds | |
| 2020/0170418 | A1 | 6/2020 | Oh et al. | |
| 2020/0198509 | A1 | 6/2020 | Conze et al. | |
| 2020/0237106 | A1 | 7/2020 | Alletto, Jr. et al. | |
| 2020/0397148 | A1 | 12/2020 | Elliott et al. | |
| 2021/0204709 | A1 | 7/2021 | Grabinger et al. | |
| 2021/0204720 | A1 | 7/2021 | Karschnik et al. | |
| 2021/0227987 | A1* | 7/2021 | Alletto, Jr. | A47C 20/048 |
| 2021/0307524 | A1 | 10/2021 | Nishida et al. | |
| 2021/0307525 | A1 | 10/2021 | Kim et al. | |
| 2021/0307529 | A1 | 10/2021 | Kim et al. | |
| 2021/0307531 | A1 | 10/2021 | Lee et al. | |

FOREIGN PATENT DOCUMENTS

| | | | | |
|---|---|---|---|---|
| CN | 204105404 | U | 1/2015 | |
| DE | 20113292 | U1 * | 9/2002 | A47C 21/044 |
| DE | 102017003332 | A1 | 10/2018 | |
| EP | 1804616 | B1 | 2/2012 | |
| EP | 0957727 | B1 | 3/2022 | |
| GB | 379439 | A | 9/1932 | |
| GB | 2334889 | A | 9/1999 | |
| JP | S5670719 | A | 6/1981 | |
| JP | H04108411 | A | 4/1992 | |
| JP | H04108498 | A * | 4/1992 | A47C 21/04 |
| JP | H09140506 | A | 6/1997 | |
| KR | 20140071931 | A * | 6/2014 | A61F 7/08 |
| KR | 20180053024 | A | 5/2018 | |
| KR | 20200092139 | A * | 8/2020 | A47C 21/048 |
| KR | 20200002751 | U * | 12/2020 | A47C 21/04 |
| WO | 1996039905 | A1 | 12/1996 | |
| WO | 2005120295 | A1 | 12/2005 | |
| WO | 2013017869 | A1 | 2/2013 | |

OTHER PUBLICATIONS

Freshbed, "FreshBed iFo 3D-Animation," (https://www.youtube.com/watch?v=j9J3eINZuu0), Nov. 18, 2020.

International Search Report and Written Opinion dated Apr. 22, 2022 in International Application No. PCT/NL2022/050129, 16 pages.

* cited by examiner

SUPPORT CONSTRUCTION FOR CONDITIONED FURNITURE, AND ASSOCIATED SYSTEMS AND METHODS

TECHNICAL FIELD

The present technology is directed generally to support constructions for conditioned furniture, and associated systems and methods.

BACKGROUND

Beds having integral air-ventilation (so-called "ventilated beds") typically include a permeable mattress supported by a support platform. The platform includes internal plenums and a fan to provide filtered, as well as heated, airflow up through the permeable mattress of the bed and into contact with a recumbent user, as controlled by the user. It is believed that providing a user in bed with a controlled up-flow of conditioned air improves the comfort and quality of the user's sleep, as well as the user's overall health.

EP1804616A1 discloses environmentally conditioned furniture, such as a bed, with a permeable mattress or cushion set upon a plenum chamber base, with a ventilator fan, a distribution duct and heater, co-operatively disposed to intake ambient air and expel conditioned chamber air through the mattress under temperature and relative humidity control, for the comfort and/or respiratory benefit of a bed occupant.

SUMMARY

Representative embodiments of the present technology include a bed structure that provides no noise or at least less noise compared to existing beds, e.g., by addressing constructions that may cause squeaking or cracking noises during movement. As such, it may be beneficial to provide more stable constructions and/or constructions in which particular elements are separated to prevent contact that may cause noises during movement.

A representative embodiment of the present technology includes a construction for a conditioned piece of furniture that effectively supports an upholstery or cushioning item, e.g., a mattress, and is easy to assemble. It can also provide a construction for a conditioned bed that accommodates a conditioning unit, and that provides convenient access to the conditioning unit. Examples of furniture are couches, chairs, convertible sofas, sleeper sofas, chaises lounges, and/or any other suitable furniture comprising a mattress or cushion on which a person may sit and/or lie down.

A first aspect includes a bed construction for a conditioned piece of furniture (e.g., a bed), comprising a tub-shaped shell structure having an opening providing access to a plenum within the shell structure, and an upholstery support supported by the shell structure and arranged to support an upholstered item above the opening. The furniture can further comprise a conditioning unit provided in the plenum arranged to condition air and provide conditioned air to the upholstered item, an open rigid base frame connected to the shell structure, surrounding the plenum, and arranged to support the shell structure; and at least four legs extending from the base frame and arranged to support the base frame.

The shell structure may have an open top, wherein a mattress support platform can be provided atop the outer shell for supporting a mattress thereon, e.g., an air permeable mattress. The conditioning unit is arranged to provide conditioned air through the permeable mattress, cushioning or other upholstered item provided on the frame. Such conditioning may include one or more of the following: providing air through the upholstered item (e.g., a mattress) or withdrawing air therefrom, heating, cooling, filtering, humidifying, dehumidifying, sterilising, scenting, de-scenting, other, and/or a combination thereof. For the purpose of conditioning, the conditioning unit may comprise a fan and a heating element, to establish an airflow. The conditioning unit can draw air in from the environment outside the bed construction, for example through an air inlet opening in the tub-shaped outer shell. The outer shell can be generally closed, so as to direct the flow of air upward, towards and through the mattress.

The leg module may comprise one or more legs, extending downward from the base frame. In case of one leg, the leg can be provided with a foot structure having dimensions suited to provide proper balance to the support structure. In case of two legs, each leg may be provided at opposite ends of the base frame. One option, when the base frame has a rectangular shape, is to provide a leg in the middle of the short sides of the rectangle. Also four or more legs may be provided. In case of four legs and a generally rectangular base frame, legs are connected to the base frame at or close to the corners of the rectangle, either on the long or short side.

By providing the base frame and connecting the legs thereto, rather than to the shell structure, more freedom of design can be provided. Beds may have legs connected to an external structure, which external structure provides support for a mattress. With beds having the leg module, with one, two, three, four or more legs connected to an external structure of the beds, the external structure has to be rigid and the material has to be strong enough to support the weight of the bed and the forces of the legs acting on the external structure. With an insufficiently rigid and/or strong external structure, for example due to at least one of choice of material, material thickness, design of shape, other, or a combination thereof, this may result in breaking of the structure, a loose connection or loosening of the connection between the external structure and the legs, or an otherwise poor connection. This, in turn, may result in squeaking connections that make noises when one or more persons in the bed move, and/or may result in poor stability of the bed.

With a rigid base frame, apart from the shell structure, a sturdy frame and a sturdy, rigid and reliable connection between the frame may be provided by a proper choice of materials and design, fit for the purpose of providing mechanical support to the bed or other furniture. The shell structure is subsequently supported by the base frame. The mattress may be supported by the shell structure, in turn. Internally, the shell structure may be designed to transfer forces from the mattress to the base frame and externally, the shell structure may present an aesthetically appealing shape. With beds having legs directly connected to the external structure, as visible places, this is not possible in a reliable way—or in any case, is far more difficult to execute.

A second aspect provides a bed construction for a ventilated bed, comprising a tub-shaped outer shell forming a cavity for accommodating a ventilation unit; a base frame provided in the cavity and being attached to the outer shell for supporting the outer shell; and at least four legs extending from the base frame, wherein the at least four legs extend from the base frame through respective openings in a bottom of the outer shell. The base frame provides a sturdy base structure for supporting other components of the bed construction. The base frame may be manufactured from aluminium, titanium, steel, another metal or metal alloy, an organic polymer, wood, a pressed composite material, other, or a combination thereof. The legs extending through respective openings in the outer shell enable a direct connection of the legs to the base frame (e.g., a metal base frame) such that a rigid and robust construction can be obtained, while the metal base frame is compactly accommodated in the cavity of the outer shell. The outer shell may, for example, be manufactured from a plastic to minimise the weight of the bed construction. The legs can support the bed construction on any suitable support surface, e.g., the floor.

In an embodiment, the base frame forms a rectangular frame, wherein the at least four legs extend from the rectangular frame at or near respective corners thereof.

In an embodiment, the base frame comprises one or more hollow beams. Hence, a light-weight and stiff construction can be obtained.

In an embodiment, the bed construction comprises a first foot and a second foot for supporting the ventilated bed on a floor surface, wherein each foot of the first and second foot is coupled to at least two legs of the at least four legs, and extends generally parallel to the bottom of the outer shell. The first foot and the second foot increase the footprint of the bed, e.g., the contact interface of the bed construction and the ground, to evenly distribute the load of the bed, and a person laying on the bed, over a larger ground contact area.

In an embodiment, the first foot and the second foot both extend in a width or width-wise direction of the bed construction, the first foot being coupled to two legs at or near a head-side of the bed construction, the second foot being coupled to two foot-sides of the bed construction. A length or length-wise direction can be defined as the direction from the intended foot-side of the bed construction to the intended head-side of the bed construction. The width direction is defined as the direction transverse to the length direction, parallel to a mattress support platform. In one embodiment, the width dimension of the furniture or a part thereof is smaller than the length dimension of the furniture or a part thereof. Alternatively, the length dimension is defined by an intended sleeping position of a user of the furniture; if the furniture is a bed, the length is defined parallel to the length of a person in an intended (sleeping) position on the bed.

In an embodiment, the first foot and the second foot span approximately the entire width of the outer shell.

In an embodiment, each leg of the at least four legs has a bore that extends through the leg, wherein a bolt is provided through the bore so as to couple each leg at one end to the metal base frame and at an opposite end to the first foot or the second foot.

In an embodiment, each leg of the at least four legs has associated therewith a washer plate for forming an engagement point for the bolt, the metal base frame, or at least part thereof, being provided between the washer plate and the leg.

In an embodiment, the bed construction comprises a mattress support that defines a mattress support platform for supporting a mattress, wherein the mattress support comprises an inner shell provided at a top side of the tub-shaped outer shell, and having a central opening for providing access to the cavity.

In an embodiment, the mattress support comprises a ventilation grille arranged in a plane of the central opening of the inner shell.

In an embodiment, the central opening is formed by a recessed portion of the mattress support, recessed towards the bottom of the outer shell, the recessed portion having a support surface configured for supporting the mattress support on the metal base frame.

In an embodiment, the recessed portion of the inner shell comprises a seat for receiving a ventilation unit.

In an embodiment, the inner shell comprises, in the recessed portion, an air inlet opening.

In an embodiment, the tub-shaped outer shell comprises, at the bottom side, an air inlet opening.

A third aspect provides a mattress support for a bed construction, particularly for a bed construction in accordance with the first and second aspects. The mattress support comprises a mattress support platform for supporting a mattress thereon. The mattress support platform comprises an opening for allowing a flow of air therethrough, and is provided with an upstanding ridge projecting from the support platform, and extending around the opening. The upstanding ridge provides a seal between the mattress support platform and the mattress. Hence, when a mattress is positioned on the mattress support platform, the upstanding ridge projects into tight contact with the bottom mattress surface, thereby locally compressing the mattress to create a barrier that prevents or at least reduces air from escaping laterally between the mattress and the support platform.

This aspect particularly provides an improved seal with the mattress if a cover is provided around the mattress, for example by means of one or more sheets. In such cover, there may be folds and/or wrinkles if provided around the mattress, which may provide channels that may provide a leakage path to the environment, rather than forcing air to pass to and through the mattress. With an improved seal, such leakage is reduced or may even be prevented. Furthermore, this aspect and embodiments thereof may provide an improved sealing between the support platform and a ventilation grille or grid of slats provided in the support. A broad support platform provided around an opening in the bed support may in that sense also contribute to an improved seal. To further improve the seal, a coating may be provided on the support platform.

The mattress may further comprise an at least approximately air-impermeable sidewall, such that the air introduced into the mattress is prevented (or at least inhibited) from escaping through the side walls.

In an embodiment, the mattress support comprises a ventilation grille arranged in a plane of the opening, wherein the upstanding ridge is provided generally along the perimeter of the ventilation grille. The ventilation grille can be a slatted panel, comprising a plurality of slats, spaced apart to define, a plurality of openings for allowing an air flow therethrough.

In an embodiment, the upstanding ridge is detachably coupled to the ventilation grille. For example, the upstanding ridge is detachably coupled to a perimeter edge of the ventilation grille.

In an embodiment, the upstanding ridge projects upwardly between 2 mm and 8 mm, for example between 4 mm and 6 mm, as measured from an upper surface of the support platform.

It will be appreciated that any one or more of the above aspects, features and embodiments can be combined. It will be appreciated that any one of the embodiments described in view of one of the aspects can be applied equally to any of the other aspects. It will also be clear that all aspects, features and embodiments described in view of the bed construction apply equally to mattress support and vice versa.

BRIEF DESCRIPTION OF THE DRAWINGS

The present technology will further be elucidated on the basis of representative embodiments which are represented in the drawings. The representative embodiments are provided by way of non-limitative illustration. It is noted that the figures are only schematic representations of embodiments of the present technology that are given by way of non-limiting example.

In the drawings.

DETAILED DESCRIPTION

Figure 1A:
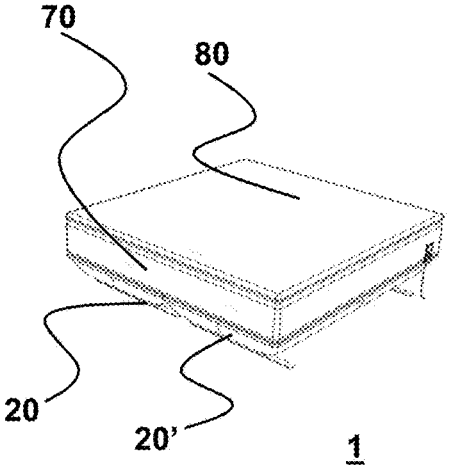
FIG. 1A shows a perspective view of a representative double bed.

FIG. 1A shows a representative first bed construction 1. The bed construction 1 provides a double bed. The bed construction comprises a support having a first outer shell 20 for supporting a first person, a second outer shell 20' for supporting a second person, a mattress 70 as a first upholstered item, supported at least partially by the first outer shell 20 and the second outer shell 20' and a topper mattress 80 as a second upholstered item.

Figure 1B:
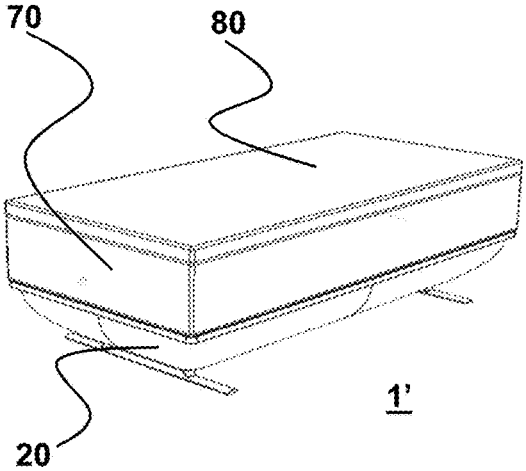
FIG. 1B shows a perspective view of a representative single bed.

FIG. 1B shows another representative first bed construction 1'. The bed construction 1' provides a single bed. The bed construction comprises a support having an outer shell 20, a mattress 70 as a first upholstered item, supported by the outer shell 20, and a topper mattress 80 as a second upholstered item.

Figure 1C:
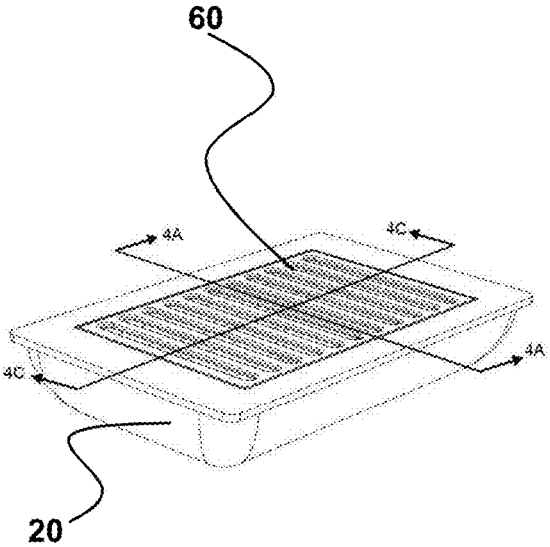
FIG. 1C shows a perspective view of a representative single bed without a mattress and with a ventilation grille.
Figure 1D:
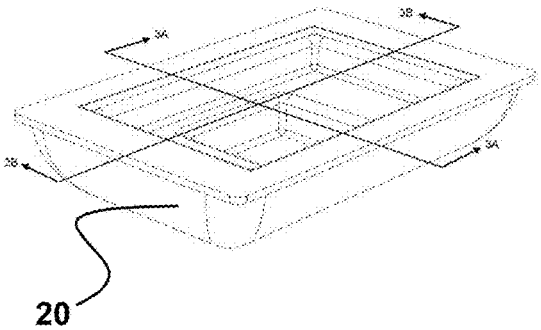
FIG. 1D shows a perspective view of a representative single bed without a mattress without the ventilation grille.

FIG. 1C shows a representative bed construction 1 with the mattress 70 removed. Removing the mattress exposes a ventilation grille 60. FIG. 1D shows the bed construction 1 with the ventilation grille 60 removed.

FIGS. 2A-2D show a base frame 10 for a bed construction 1. The base frame 10 includes four beams 11*a*, 11*b*, 11*c*, 11*d*, which may be metal beams, such as aluminium beams, forming a rectangular frame, defining an open center 15. Alternatively or additionally, one or more of the four beams 11*a*, 11*b*, 11*c* and 11*d* may be at least partially and optionally fully formed from a composite material. As used herein, a composite material refers generally to a compound comprising at least two materials having different material characteristics. A first material may be a cured polymer, like epoxy or polyester. A second material may be a fibrous material, including, but not limited to glass, polymers or natural fibres.

To reduce the weight of the base frame 10, the beams 11*a*, 11*b*, 11*c*, 11*d* are generally hollow or open. In this example, the head-side beam 11*a* (that is, the beam located adjacent and parallel to the head side of the bed) and an opposing foot-side beam 11*c* both have a tubular profile. Side beams 11*b*, 11*d* have a C-shaped profile, but it will be appreciated that other beam profiles can be used, such as I-shaped, H-shaped, rectangularly shaped, circularly or otherwise curved, L-shaped, open, closed, other, or a combination thereof. Beams 11*a*, 11*b*, 11*c*, 11*d* are secured to each other to form the generally-rectangular shape shown in FIG. 2A, using known techniques, for instance, welding, use of mechanical fasteners (e.g., screws, bolts), using an appropriate adhesive, and/or other suitable techniques or any combination of the foregoing techniques.

Figure 2A:
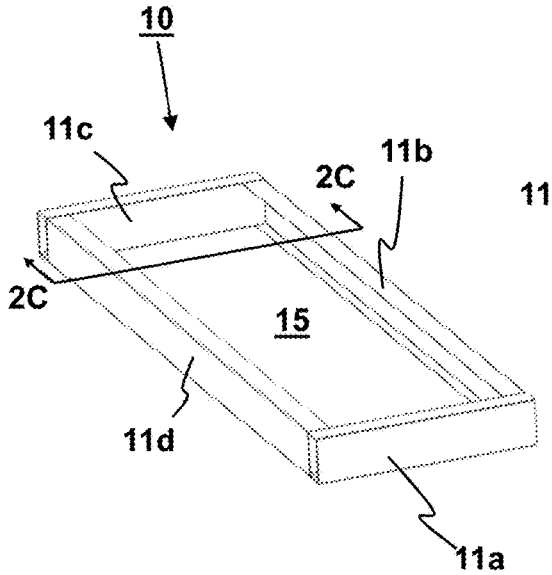
FIG. 2A shows a perspective view of a representative frame for a bed construction, according to embodiments of the present technology.
Figure 2B:
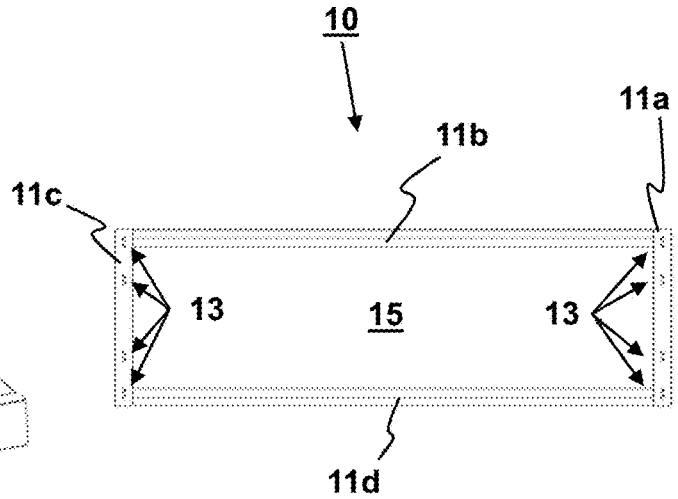
FIG. 2B shows a bottom plan view of the frame of FIG. 2A, according to embodiments of the present technology.
Figure 2C:
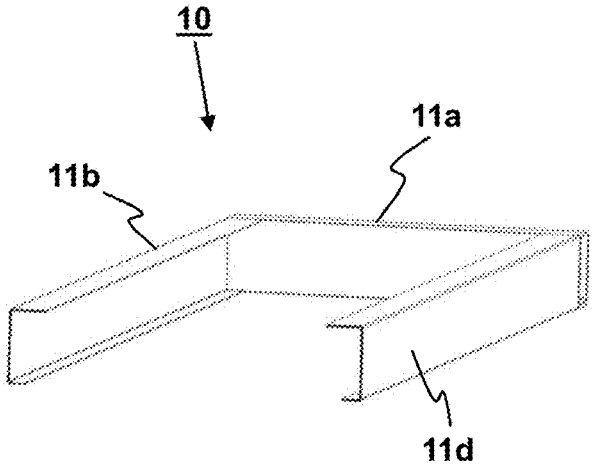
FIG. 2C shows a sectional view of the frame of FIG. 2A, taken generally along line 2C-2C of FIG. 2A, according to embodiments of the present technology.

FIG. 2B shows a bottom view of the base frame 10, wherein a multitude of mounting holes 13 are provided in the bottom of the head-side beam 11*a* and foot-side beam 11*c*. The mounting holes are used to receive mechanical fasteners for mounting legs, e.g. four legs, to the base frame 10, as described below. Mounting holes 13 are particularly provided near the corners of the rectangular base frame 10. As described below, a shell component of the bed structure can also be mounted to the base frame 10, using one or more of the mounting holes 13.

Figure 2D:
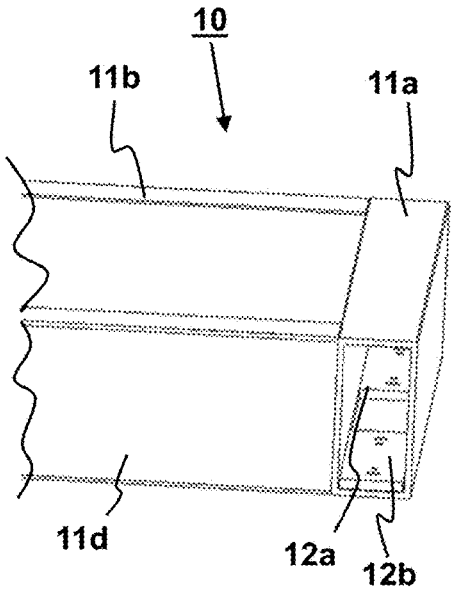
FIG. 2D shows a perspective view of one end of the frame of FIG. 2A, showing details thereof, according to embodiments of the present technology.
Figure 5A:
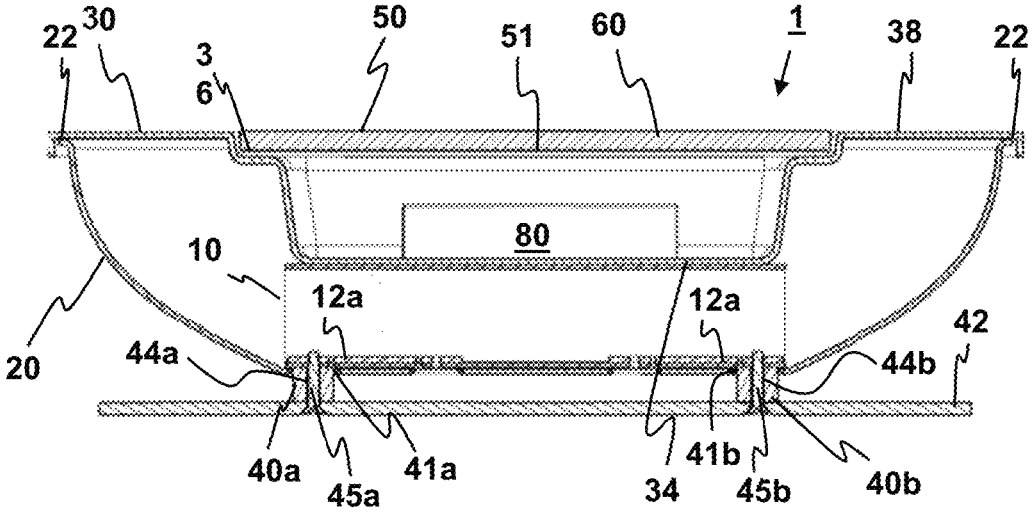
FIGS. 5A-5C show a representative bed construction for a ventilated bed.
Figure 5B:
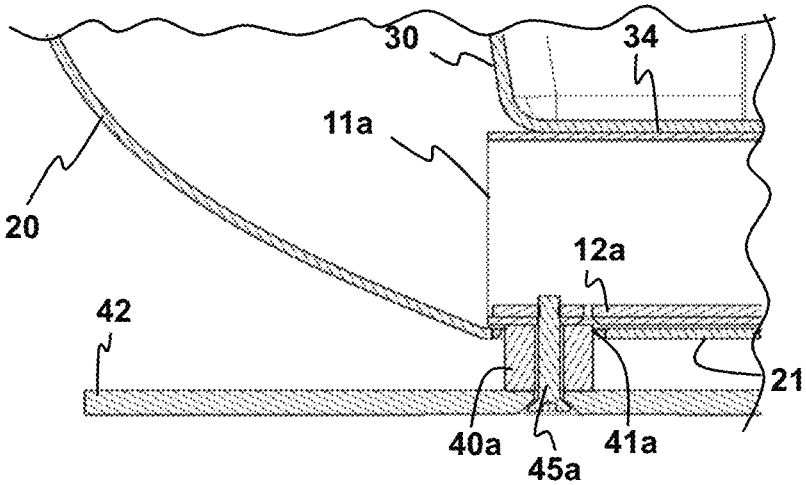

FIG. 2D shows two washer plates 12*a*, 12*b*, positioned within hollow head-side beam 11*a* and foot-side beam 11*c* (FIG. 2A) of base frame 10. As shown in FIG. 5B, washer plates 12*a*, 12*b* comprise bores, optionally having a thread—also possibly having a smooth bore without a thread—that are sized to engagingly receive a mechanical fastener, as described in greater detail below, for connecting one or more legs to base frame 10. Washer plates 12*a*, 12*b* are arranged to distribute the compressive and torque forces generated by engaged mechanical fasteners and any such forces associated with the weight of the bed construction and anybody using the bed. Washer plates 12*a*, 12*b* may be made from steel, but also from any other suitable material, and can be the same material as is used for the base frame 10, or part thereof, or another material, or a combination thereof.

Figure 3A:
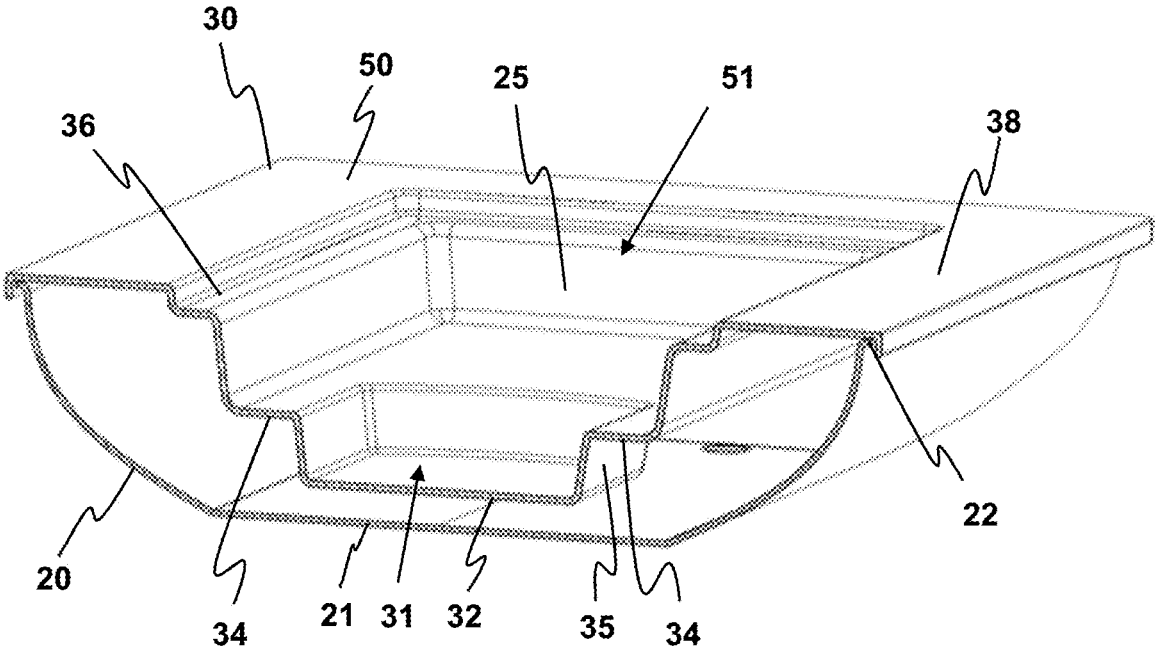
FIGS. 3A and 3B show cross sectional views of an outer and inner shell for a bed construction, taken generally along lines 3A-3A, and 3B-3B, respectively, of FIG. 1D.
Figure 3B:
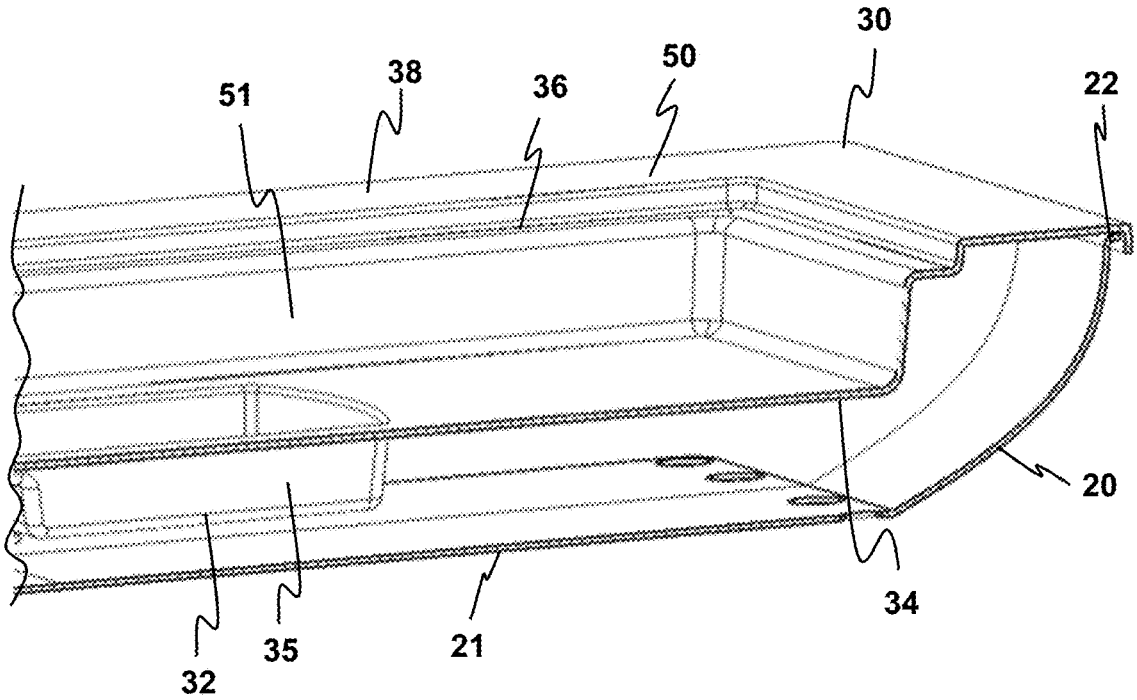

FIGS. 3A and 3B show, respectively, a transverse and longitudinal cross-sectional view of an assembly of an outer shell 20 and an inner shell 30 of a bed construction 1, taken generally along lines 3A-3A and 3B-3B as shown in FIG. 1D. The outer shell 20 is generally tub-shaped, and defines a cavity 25 for accommodating a ventilation unit 80, (e.g., a type of conditioning unit, as shown in FIG. 5A). The outer shell 20 has a generally closed surface and has an open top to direct a flow of air generated by the ventilation unit 80, in an upward direction. In the bed construction 1, the outer shell 20 and the inner shell 30 are glued together to provide a monocoque bed support body.

In the illustrated example, the outer shell 20 has a generally flat bottom portion 21. The inner shell 30 is secured to outer shell 20, as shown in FIGS. 3A and 3B and is shaped to define a central recess 31, located adjacent to the bottom portion 21 of the outer shell 20. The inner shell 30 provides, at least partially, a mattress support for supporting a mattress. For example, a peripheral portion 38 of inner shell 30 forms at least a part of a mattress support platform 50 for supporting a mattress, wherein the central recessed portion 31 defines an opening 51 in the support platform 50, as shown in FIGS. 3A and 3B. The inner shell 30 can rest on an upper edge 22 of the outer shell 20.

The central recess 31 of the inner shell 30 includes a seat 32 for holding a ventilation unit 80 (shown in FIG. 5A). The ventilation unit 80 may be conventional and may comprise a fan and a heater. In the assembled state, the seat 32 is spaced from the bottom 21 of the outer shell 20, as shown in FIG. 3A, to allow for airflow between the inner shell 30 and outer shell 20. The inner shell 30 further comprises a support surface 34 for supporting the inner shell 30 on the base frame 10, as shown in FIGS. 5A and 5B. The support surface 34 extends around the seat 32. The seat 32 is recessed relative to the support surface 34 to lower the centre of gravity of the bed construction 1. Moreover, a side wall 35 located adjacent to the seat 32 may provide structural rigidity of the shell assembly by preventing a lateral displacement of the inner shell 30 relative to the base frame 10. The inner shell 30 may be fixed to the base frame 10, for example, by means of an appropriate adhesive or mechanical fastener, thereby forming a releasable or non-releasable connection. This connection may be provided by means of various techniques, including gluing, screwing, welding, bolting, nailing, using a snap-fit connection, and/or other appropriate techniques, and/or a combination thereof.

The central recess 31 also includes a ventilation grille seat 36 for receiving a ventilation grille, described below, e.g., a slatted bed base. The ventilation grille seat 36 is recessed relative to the mattress support platform 50, such that a top face of the ventilation grille is flush with the support platform 50. Hence, the recess 31 is generally stepped.

Figure 4A:
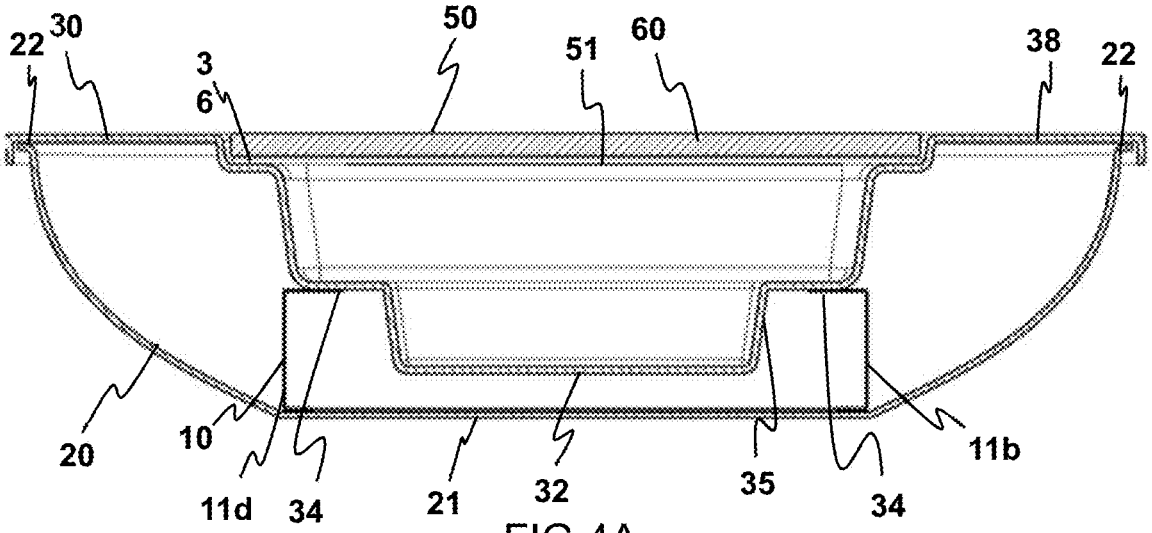
FIGS. 4A-4C show cross sectional views of an outer and inner shell for a bed construction taken generally along line 4A-4A of FIG. 1C (for FIGS. 4A and 4B), and generally along line 4C-4D (for FIG. 4C)
Figure 4B:
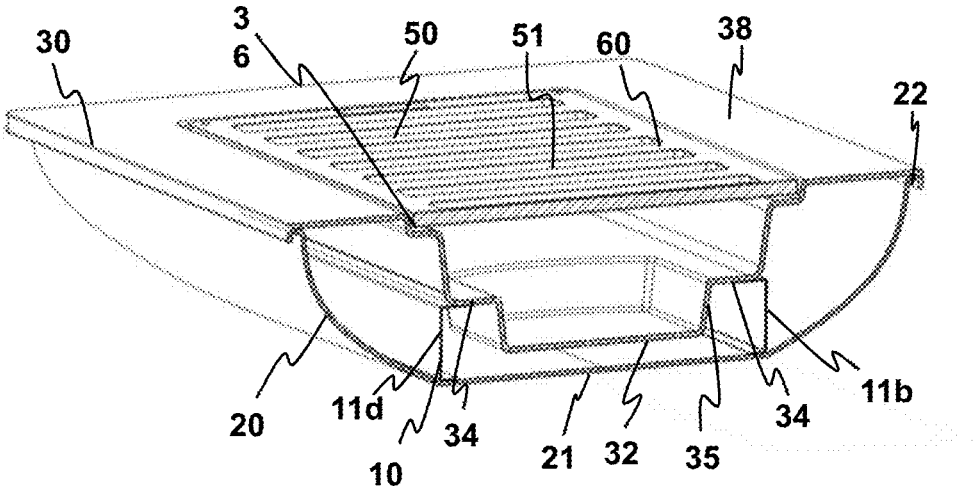
Figure 4C:
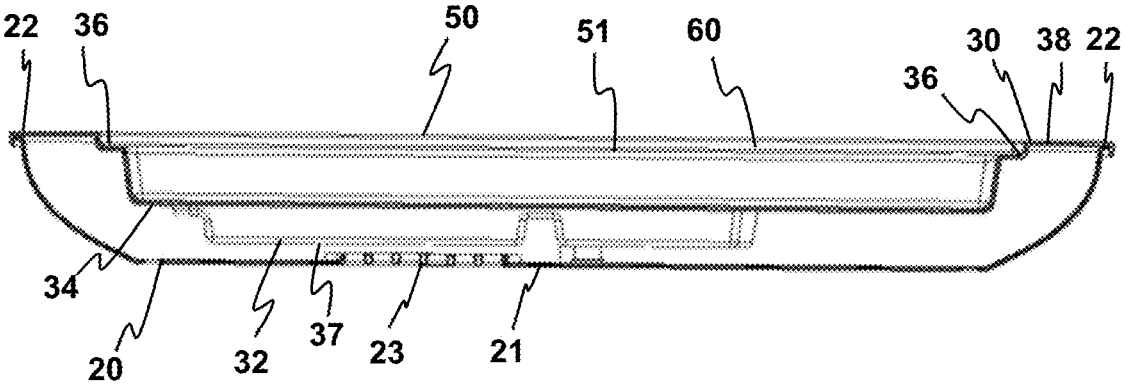

FIGS. 4A, 4B and 4C show respectively a transverse and longitudinal cross-sectional view of an assembly of an outer shell 20 and an inner shell 30 of a bed construction 1, taken generally along line 4A-4A (FIGS. 4A and 4B), and generally along line 4C-4C (FIG. 4C) as shown in FIG. 1C. In FIGS. 4A-4C, a ventilation grille 60 is shown positioned in the ventilation grille seat 36 of the inner shell 30, wherein the ventilation grille 60 resides in a plane defined by the mattress support platform 50. In this example, ventilation grille 60 includes a plurality of slats, laterally arranged with respect to the bed construction 1 (in the width direction) and spaced from each other to form open spaces therebetween. Openings are provided to allow air to flow from the cavity 20 up through mattress, when supported on the mattress support platform 50. It will be appreciated that other ventilation grilles can be used. Such other ventilation grilles may be provided by means of individual slats, connected to one another or not, planar vents with holes having other oblong shapes or other shapes, other arrangements, or a combination thereof. Although other grills may be used, it is relevant that the total area of the grill-openings is sufficient to pass the airflow generated by the ventilation unit 80 without unwanted resistance or obstruction.

FIGS. 4A-4C further show that base frame 10 is positioned in the cavity 25 (FIG. 3A) of the outer shell 20, and arranged between the outer shell 20 and the inner shell 30. The base frame 10 supports the inner shell 30, wherein the seat 32, used to hold the ventilation unit 80 is recessed into the central opening 15 (FIGS. 2A, 2B) of the rectangular base frame 10.

The configurations of the flat bottom portion 21 of the outer shell 20 and base frame 10 are adapted to one another, to facilitate the alignment of the base frame 10 relative to the outer shell 20 during assembly of the bed construction 1. In other words, the base frame 10 is sized and shaped to fit along the flat bottom portion 21 within the cavity 25. The outer shell 20 can be attached to the base frame 10, for example at a bottom side of the base frame 10, by means of e.g. an adhesive and/or mechanical, e.g. threaded, faster.

As best seen in FIG. 4C, seat 32 can be located closer to the foot-side of the bed construction 1 to reduce (e.g., minimize) noise perceived by a person lying on the bed. The outer shell 20 comprises, at the flat bottom portion 21, an outer air inlet opening 23, which is in fluid communication with an inner air inlet opening 37, of the inner shell 30. The air inlet openings 23, 37 may be offset with respect to one another. Hence, a fluid path is provided between the outer air inlet opening(s) 23 of the outer shell 20 and the central opening 51 of the mattress support platform 50, via inner air inlet opening(s) 37.

FIG. 5A shows a transverse cross section of the bed construction 1, wherein two legs 40*a*, 40*b* are mounted directly to the base frame 10, particularly directly to the head-side beam 11*a* and the foot-side beam 11*c*. FIG. 5B shows a detailed enlarged partial view of the cross sectional view of FIG. 5A. The legs 40*a*, 40*b* extend through respective openings 41*a*, 41*b* of outer shell 20 so that the legs are directly connected to the base frame 10. The outer shell 20 is not positioned between the legs 40*a*, 40*b* and the base frame 10. This arrangement allows for increased (e.g., optimized) stiffness of the bed construction 1 and also allows the outer shell 20 to be made of lightweight and/or more resilient material, such as a plastic—an organic polymer—, metal, wood, any other suitable material and/or a combination thereof. Also the outer shell 20 may be made from a plastic material, for example, the same material as inner shell 30. The bed construction 1 may include four legs or more.

A foot can be provided for supporting and distributing a load of the bed construction on a floor surface. In this example, a first foot 42 of the bed construction 1 is shown extending in a width direction of the bed construction, and being coupled to both of the legs 40*a*, 40*b*. Similarly, the bed construction 1 can also include a second foot (not shown), which also extends in a width direction of the bed construction, and connects with the remaining two legs located at the opposite side of the bed construction 1.

The first foot 42, and the opposite second foot (not shown), extend laterally between their respective first leg 40*a* and the second leg 40*b* (in the width direction of the bed construction), in order to increase the stability and structural rigidity of the bed construction as it is being used. The first foot 42 may span generally the entire width of the outer shell 20, e.g., a dimension of the first foot 42 in a width direction of the bed construction approximately equals a width of the outer shell 22, though other dimensions, either longer or shorter, are possible as well. It will be appreciated that first foot 42 and the second foot extend in a plane parallel to the mattress support platform 50, such that the mattress support platform (and therefore the mattress) is parallel to, and level with the floor surface where the bed 1 resides.

The legs 40*a*, 40*b* each include a corresponding through hole 44*a*, 44*b* which is sized and shaped to receive a mechanical fasteners therethrough. In this example, a bolt 45*a*, 45*b* is provided through each through hole 44*a*, 44*b* in the legs 40*a*, 40*b*. The bolts 45*a*, 45*b* engage the first foot 42 at one end of the bolt, and threadingly engage threaded bores of washer plates 12*a*, 12*b* (see also FIG. 2D). It will be appreciated that the bolt can additionally or alternatively engage the base frame 10 with or without the use of the washer plates 12*a*, 12*b*. This way, the legs 40*a*, 40*b* can be tightly compressed or clamped between the base frame 10 and the first foot 42, optionally owing to the tightening action of bolts 45*a*, 45*b*. Hence, each leg can be mounted to the base frame 10, as well as to the first or second foot 42, by means of a single bolt. This facilitates convenient and efficient assembly of the bed construction 1. The bolts 45*a*, 45*b* can be insertable from the bottom side of the bed construction, wherein, in this example, the first and second feet include a recess for accommodating a head of the bolts.

Figure 6A:
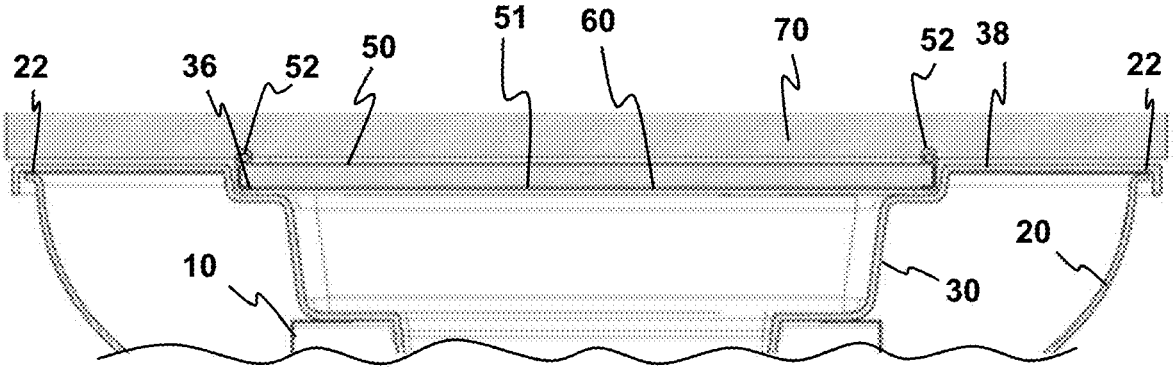
FIGS. 6A-6C show a representative bed construction for a ventilated bed.
Figure 6B:
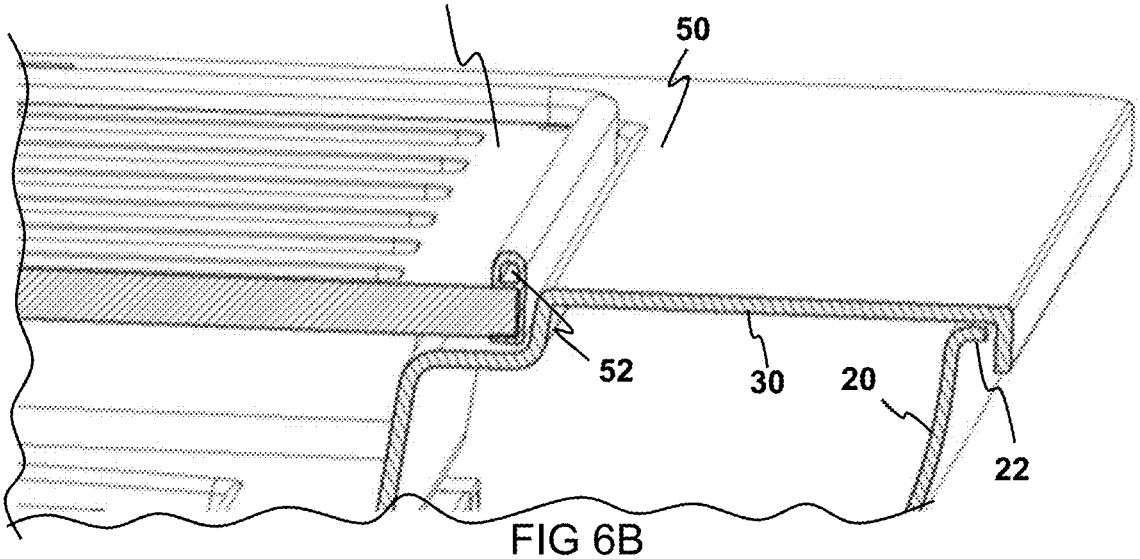
Figure 6C:
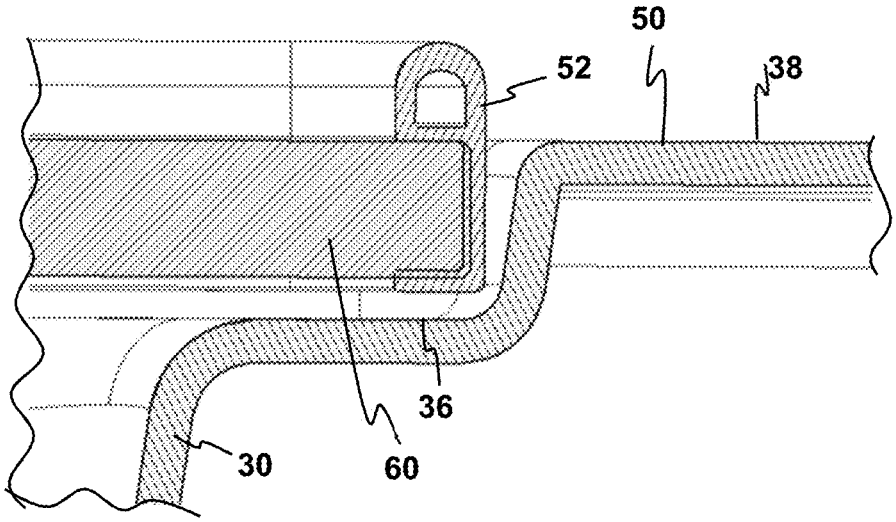

FIGS. 6A-6C show a bed construction, in particular, a mattress support platform 50 for supporting a mattress 70. The mattress support platform 50 includes a central opening 51, in which a ventilation grille 60 extends. The ventilation grille 60 defines a plurality of openings for allowing a flow of air therethrough.

Extending from support platform 50 is an upwardly-directed ridge 52 which operates as a seal, and which extends around the central opening 51. The upwardly-directed ridge 52 provides, in cooperation with the mattress 70, a seal to prevent air from escaping laterally between the mattress support platform 50 and the mattress 70, or at least to reduce air flow between the mattress 70 and the support platform 50. This forces most, if not all airflow generated by the ventilation unit 80 to pass through the mattress 70 and not be wasted by leaking out below the mattress.

An airflow, e.g., the one generated by the ventilation unit 80 mounted within the seat 32 (FIG. 4C), is directed through the central opening 51, through the openings in the ventilation grille 60, and eventually, through the mattress 70, into direct contact with a sleeping user.

The upwardly-directed ridge 52, in this example, has a D-shaped profile, but it will be appreciated that other profiles shapes and configurations are possible, either hollow or solid. The upwardly-directed ridge 52 can further be detachably coupled to the support platform 50, for example detachably coupled to the ventilation grille 60. For example, the ridge 52 can attach to the perimeter edge of the ventilation grille 60, as shown in FIG. 6A, 6B. The ridge 52 may extend upwardly by any amount or distance, e.g., by a distance between 2 millimetres and 30 millimetres, from any value of 2, 3, 4, 5, 8, 10, 12, 14, 15, 20 millimetres to any value of 4, 6, 8, 10, 12, 14, 15, 20, 25, 30 millimetres.

Figure 5C:
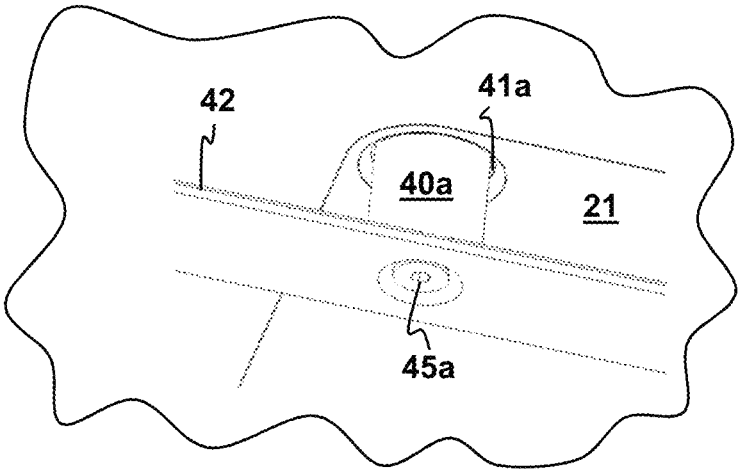

In order to facilitate selective securement of the upwardly-directed ridge 52 to the ventilation grille 60, the upwardly-directed ridge 52 may comprise a coupling rim that fits around the perimeter of the ventilation grille 60. The coupling rim may be have a C-shaped cross-section that is sized and shaped to receive and hold the edge of the grille 60. In other embodiments, the upwardly-directed ridge 52 may be secured, as a separate part, to the support platform 50 so that it surrounds the opening 21 (FIG. 5C), or integrally-formed with the grille 60, or the support platform 50. As such, the upwardly-directed ridge 52 may provide improved sealing between the support platform and the grille 60.

In one embodiment, the upwardly-directed ridge 52 has a profile that includes an L-shaped section, which is sized and shaped to receive and hold edge of the grille 60, as shown in FIG. 6C, and further provide a seal between a lower surface of the grille 60 and a seat 36, integrally-formed into the inner shell 30.

The upwardly-directed ridge 52 may be manufactured by extrusion moulding, injection moulding, other, and/or a combination thereof, of an elastomer, rubber in particular, either natural or synthetic, and/or another resilient material. The material used to make the upwardly-directed seal 52 optionally does not mark or damage the underside of the mattress 70 and can be made with a material that forms a suitable seal between grille 60 and the underside of mattress 70.

Herein, the technology is described with reference to specific examples of embodiments. It will, however, be evident that various modifications, variations, alternatives and changes may be made therein, without departing from the presently disclosed technology.

For the purpose of clarity and a concise description, features are described herein as part of the same or separate embodiments; however, other embodiments having combinations of all or some of the features described in these separate embodiments are also envisaged and understood to fall within the framework of the present technology as outlined by the claims. The specification, figures and examples are, accordingly, to be regarded in an illustrative sense rather than in a restrictive sense. The presently disclosed technology is intended to embrace all suitable alternatives, modifications and variations which fall within the scope of the appended claims. Further, many of the elements that are described are functional entities that may be implemented as discrete or distributed components or in conjunction with other components, in any suitable combination and location.

In the claims, any reference signs placed between parentheses shall not be construed as limiting the claim. The word 'comprising' does not exclude the presence of other features or steps than those listed in a claim. Furthermore, the words 'a' and 'an' shall not be construed as limited to 'only one', but instead are used to mean 'at least one', and do not exclude a plurality. The mere fact that certain measures are recited in mutually different claims does not indicate that a combination of these measures cannot be used to an advantage.

As used herein, the term "and/or," as in "A and/or B" refers to A alone, B alone and both A and B. As used herein, the terms "about" and "approximately" refer to values within 10% of the stated value.

The following Examples provide additional embodiments of the present technology.

1. A support construction for conditioned furniture, comprising:

a support structure having:

a tub-shaped shell structure including an opening providing access to a plenum within the shell structure; and an upholstery support supported by the shell structure and arranged to support an upholstered item above the opening;

a conditioning unit provided in the plenum and arranged to condition air and provide conditioned air to the upholstered item;

an open rigid base frame connected to the shell structure, at least partially surrounding the plenum, and arranged to support the shell structure; and a leg module extending from the base frame and arranged to support the base frame.

2. The support construction of example 1, wherein the leg module comprises one or more legs extending from the base frame through respective openings in a bottom of the shell structure.

3. The support construction of example 1 or 2, wherein the base frame forms a rectangular frame, wherein the legs extend from the rectangular frame at or near respective corners thereof.

4. The support construction of example 1, wherein the base frame comprises:

a first pair of rigid beams having at least approximately the same length and provided at a distance to one another, parallel to one another;

a second pair of rigid beams having at least approximately the same length and provided at a distance to one another, parallel to one another;

wherein a first beam of the first pair connects the beams of the second pair at first ends and a second beam of the first pair connects the beams of the second pair at second ends, the second ends being opposite to the first ends.

5. The support construction of example 4, wherein beams of at least one of the first pair and the second pair have a C-shaped cross-section and the openings of the beams of the at least one pair face one another.
6. The support construction of any preceding example, further comprising a first foot and a second foot for supporting the ventilated bed, wherein each foot of the first and second foot is coupled to at least one leg, and extends at least approximately parallel to the bottom of the shell structure.
7. The support construction of example 6, wherein the first foot and the second foot both extend in a width direction of the bed construction, the first foot being coupled to at least one leg at or near a head-side of the bed construction, the second food being coupled to two a foot-side of the bed construction.
8. The support construction of example 6 or 7, wherein the first foot and the second foot span at least approximately the entire width of the shell structure.
9. The support construction of any of examples 6-9, wherein each leg has a bore that extends through the leg, and wherein a bolt is provided through the bore so as to couple each leg at one end to the base frame and at an opposite end to the first foot or the second foot.
10. The support construction of example 9, wherein each leg has associated therewith a washer plate for forming an engagement point for the bolt, the base frame, or at least part thereof, being provided between the washer plate and the leg.
11. The support construction of any preceding example, wherein the shell structure comprises an outer tub-shaped shell having a first cavity and an inner tub-shaped shell having a second cavity nested within the first cavity, the plenum being provided in the second cavity.
12. The support construction of any preceding example, wherein the upholstery support comprises a ventilation grille arranged in a plane of the opening of the shell structure.
13. The support construction of any preceding example, wherein the opening is formed by a recessed portion of the upholstery support, recessed towards the bottom of the outer shell, the recessed portion having a support surface positioned to support the upholstery support on the base frame.
14. The support construction of any preceding example, wherein the upholstery support is supported by the base frame.
15. The support construction of example 14 to the extent dependent on example 13, wherein the recessed portion is supported by the base frame.
16. The support construction of any preceding example, wherein the upholstery support comprises a support surface positioned to support the mattress, the support surface being positioned around the opening.
17. The support construction of any of examples 11-16, wherein the inner shell comprises, in the recessed portion, an air inlet opening.
18. The support construction of any preceding example, wherein the tub-shaped outer shell comprises, at the bottom side, an air inlet opening.
19. The upholstery support of any preceding example, further comprising an upholstery support platform positioned to support upholstery thereon, wherein the upholstery support platform includes an opening for allowing a flow of air therethrough, and wherein the upholstery support platform carries an upstanding ridge, projecting from the support platform, and extending around the opening, to provide a seal between the upholstery support platform and the upholstery.
20. The upholstery support of example 19, comprising a ventilation grille, arranged in a plane of the opening, wherein the upstanding ridge is positioned at a circumference of the ventilation grille.
21. The upholstery support of example 20, wherein the upstanding ridge is detachably coupled to the ventilation grille.
22. The upholstery support of any of examples 19-21, wherein the upstanding ridge projects by a distance of from about 2 mm to about 30 mm from the support platform.
23. The upholstery support of any of examples 19-22, wherein the upstanding ridge is resilient and comprises an elastomer.
24. The upholstery support of any of examples 19-23, wherein the upholstery support further comprises an inlay fitted in the opening and the upstanding ridge comprises a base fitted around a perimeter of the inlay.

I claim:

1. A support construction for conditioned furniture, comprising:

a support structure having:

a tub-shaped shell structure including an opening providing access to a plenum within the shell structure; and an upholstery support supported by the shell structure and arranged to support an upholstered item above the opening;

a conditioning unit provided in the plenum and arranged to condition air and provide conditioned air to the upholstered item;

an open rigid base frame connected to the shell structure, at least partially surrounding the plenum, and arranged to support the shell structure; and a leg module extending from the base frame and arranged to support the base frame;

wherein the base frame is positioned in the shell structure.

2. The support construction of claim 1, wherein the leg module comprises one or more legs extending from the base frame through respective openings in a bottom of the shell structure.

3. The support construction of claim 1, wherein the base frame is rectangular, and wherein the leg module comprises one or more legs that extend from the rectangular frame at or near respective corners thereof.

4. The support construction of claim 1, wherein the base frame comprises:

a first pair of rigid beams having at least approximately the same length and provided at a distance to one another, parallel to one another;

a second pair of rigid beams having at least approximately the same length and provided at a distance to one another, parallel to one another;

wherein a first beam of the first pair connects the beams of the second pair at first ends and a second beam of the first pair connects the beams of the second pair at second ends, the second ends being opposite to the first ends.

5. The support construction of claim 4, wherein beams of at least one of the first pair and the second pair have a C-shaped cross-section and the openings of the beams of the at least one pair face one another.

6. The support construction of claim 1, further comprising a first foot and a second foot for supporting the base frame, wherein each foot of the first and second feet is coupled to at least one leg, and extends at least approximately parallel to the bottom of the shell structure.

7. The support construction of claim 6, wherein the first foot and the second foot both extend in a width direction of the base frame, the first foot being coupled to at least one leg at or near a head-side of the base frame, the second foot being coupled to a foot-side of the base frame.

8. The support construction of claim 7, wherein the first foot and the second foot span at least approximately the entire width of the shell structure.

9. The support construction of claim 8, wherein each leg has a bore that extends through the leg, and wherein the support construction further comprises, for each leg, a corresponding bolt extending through the bore so as to couple each leg at one end to the base frame and at an opposite end to the first foot or the second foot.

10. The support construction of claim 9, further comprising, for each leg, a corresponding washer plate for forming an engagement point for the bolt, the base frame, or at least part thereof, wherein the base frame is between the washer plate and the leg.

11. The support construction of claim 1, wherein the shell structure comprises an outer tub-shaped shell having a first cavity and an inner tub-shaped shell having a second cavity nested within the first cavity, the plenum being provided in the second cavity.

12. The support construction of claim 1, wherein the upholstery support comprises a ventilation grille arranged in a plane of the opening of the shell structure.

13. The support construction of claim 1, wherein the opening is formed by a recessed portion of the upholstery support, recessed towards the bottom of the support structure, the recessed portion having a support surface positioned to support the upholstery support on the base frame.

14. The support construction of claim 13, wherein the upholstery support is supported by the base frame.

15. The support construction of claim 14, wherein the recessed portion is supported by the base frame.

16. The support construction of claim 1, wherein the upholstery support comprises a support surface positioned to support the upholstered item, the support surface being positioned around the opening.

17. The support construction of claim 11, wherein the inner shell includes, in a recessed portion of the upholstery support, an air inlet opening.

18. The support construction of claim 11, wherein the tub-shaped outer shell includes, at the bottom side, an air inlet opening.

19. The support construction of claim 1, wherein the upholstery support further comprises an upholstery support platform positioned to support upholstery thereon, wherein the upholstery support platform includes an opening for allowing a flow of air therethrough, and wherein the upholstery support platform carries an upstanding ridge, projecting from the support platform, and extending around the opening, to provide a seal between the upholstery support platform and the upholstery.

20. The support construction of claim 19, wherein the upholstery support further comprises a ventilation grille, arranged in a plane of the opening, wherein the upstanding ridge is positioned at a circumference of the ventilation grille.

21. The support construction of claim 20, wherein the upstanding ridge is detachably coupled to the ventilation grille.

22. The support construction of claim 19, wherein the upstanding ridge projects by a distance of from about 2 mm to about 30 mm from the support platform.

23. The support construction of claim 19, wherein the upstanding ridge is resilient and comprises an elastomer.

24. The support construction of claim 19, wherein the upholstery support further comprises an inlay fitted in the opening and the upstanding ridge comprises a base fitted around a perimeter of the inlay.

* * * * *